US007185693B1

(12) United States Patent
Hines

(10) Patent No.: US 7,185,693 B1
(45) Date of Patent: Mar. 6, 2007

(54) ONE-WAY VIEWING WINDOW COVERING

(76) Inventor: Robert Hines, 12 Garfield Pl., East Orange, NJ (US) 07018

( * ) Notice: Subject to any disclaimer, the term of this patent is extended or adjusted under 35 U.S.C. 154(b) by 40 days.

(21) Appl. No.: 10/820,557

(22) Filed: Jul. 19, 2004

(51) Int. Cl.
*A47H 23/00* (2006.01)

(52) U.S. Cl. ..... 160/327; 160/368.1

(58) Field of Classification Search ..... 160/350, 160/327, 328, 368.1, 351, 349.1, 290.1, 330; 248/262
See application file for complete search history.

(56) References Cited

U.S. PATENT DOCUMENTS

| | | | | |
|---|---|---|---|---|
| 481,720 | A * | 8/1892 | Scottron | 248/262 |
| 884,222 | A * | 4/1908 | Sherman et al. | 160/327 |
| 1,003,966 | A * | 9/1911 | Lathrop | 248/262 |
| 1,960,095 | A * | 5/1934 | Tonnesen | 38/102 |
| 1,970,256 | A * | 8/1934 | Terrel | 160/327 |
| 2,415,200 | A * | 2/1947 | Willett et al. | 160/328 |
| 2,886,481 | A * | 5/1959 | Swan | 156/88 |
| 4,088,173 | A * | 5/1978 | Antich | 160/238 |
| 4,497,515 | A | 2/1985 | Appelson | |
| 4,582,109 | A | 4/1986 | Fairbanks | |
| 4,842,036 | A | 6/1989 | Goodman | |
| 4,928,369 | A | 5/1990 | Schnebly et al. | |
| 5,373,863 | A | 12/1994 | Prizio | |
| D386,641 | S | 11/1997 | Gray, III | |
| 5,936,550 | A | 8/1999 | McCauley | |
| 6,296,041 | B1 * | 10/2001 | Cicero | 160/327 |
| 6,341,455 | B1 * | 1/2002 | Gunn | 52/202 |
| D473,743 | S | 4/2003 | Judkins | |

* cited by examiner

*Primary Examiner*—Blair M. Johnson

(57) ABSTRACT

An apparatus positionable across a window includes a body formed from one-way viewing material. The apparatus further includes a plurality of brackets secured to a stationary surface adjacent a window and are disposed at opposed corners thereof. A plurality of elongated rods are attached to opposed side portions of the body. The plurality of rods each has opposed end portions engageable with the plurality of brackets respectively. One of such rods is conveniently movable in a direction substantially transverse to the axis between expanded and retracted positions for advantageously moving the body between stretched and non-stretched positions respectively.

2 Claims, 4 Drawing Sheets

ONE-WAY VIEWING WINDOW COVERING

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a window covering and, more particularly, to a one-way viewing window covering for providing increased privacy.

2. Prior Art

Vertical louver type blind systems, similar to Venetian blinds in concept and operation, but formed of a large number of vertically extending elongated blind slats or louvers each pivoted about a vertical center axis for adjustment between open, closed, and desired intermediate positions, and slideable along upper and lower guide tracks have come into wide use as window blind systems, light transmission control or decorative control of transparent partitions or dividers in office space, and similar applications.

More recently, decorative vertical blind systems of similar construction, but wherein the vertically elongated blind slats are hung from an upper channel track, channel moldings, drapery rod or the like, with the blinds in some cases covered with decorator fabric, have come into use. These blind systems, when shut, impede not only the vision of those from the outside but also the occupants of the residency can not see what is going on outside their own residence.

Law enforcement officials often have a need to maintain continuous and surreptitious observation of buildings or other locations, sometimes over extended periods of time. It is often desirable that they should be able to maintain such surveillance from residencies, but it is usually difficult to do so for any length of time, since persons remaining in a residence with no window covering for extended time periods become highly obvious, and attract both notice and suspicion.

However, while such window coverings of one-way viewing material do permit observations by persons occupying a residence, they do so only imperfectly. Depending on the material used, some authorities estimate a reduction of visual quality and brilliance of as much as 50%.

Accordingly, a need remains for a one-way viewing window covering that overcomes the above-noted shortcomings.

BRIEF SUMMARY OF THE INVENTION

In view of the foregoing background, it is therefore an object of the present invention to provide a one-way viewing window covering. These and other objects, features, and advantages of the invention are provided by an apparatus positionable across a window, for concealing an interior space from being viewed from an exterior thereof.

The apparatus includes a body that has a centrally disposed longitudinal axis and oppositely spaced side portions equally spaced therefrom. The side portion extends substantially parallel to the axis along a length of the body. The body is formed from one-way viewing material for advantageously providing a line of sight extending outwardly through a window but not extending inwardly therethrough. Of course, many conventional one-way viewing materials may be employed by the present invention such as one-way viewing plastics, for example, as well known to a person of ordinary skill in the art. The body is preferably wound about one of the plurality of rods.

The apparatus further includes a plurality of brackets secured to a stationary surface adjacent a window and are disposed at opposed corners thereof. The plurality of brackets preferably include a flange portion that has an aperture for receiving a fastening member therethrough respectively, and an arcuate portion integral with the flange portion for defining a slot through which the plurality of rods can be positioned respectively. Select ones of the plurality of brackets may have a plurality of notches formed therein for simultaneously supporting a plurality of rods during non-use conditions, described hereinbelow.

Such a plurality of elongated rods are vertically oriented and attached to opposed side portions of the body. The plurality of rods are preferably be formed to have substantially similar lengths and diameters respectively. The plurality of rods have opposed end portions engageable with the plurality of brackets respectively, wherein one of such rods is conveniently movable in a direction substantially transverse to the axis. In particular, such a rod is transferable between expanded and retracted positions for advantageously moving the body between stretched and non-stretched positions respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
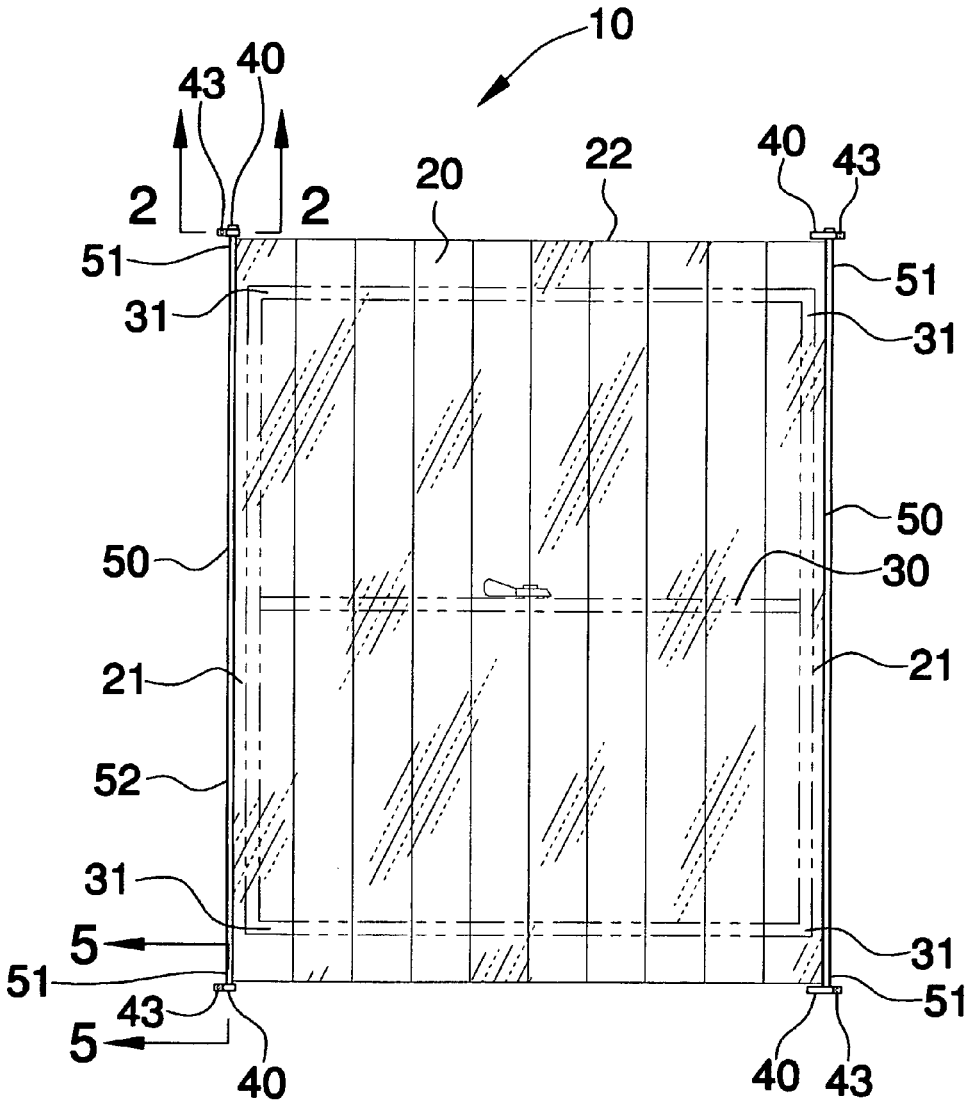
FIG. 1 is a front elevational view showing an apparatus for a one-way viewing window covering, in accordance with the present invention.
Figure 2:
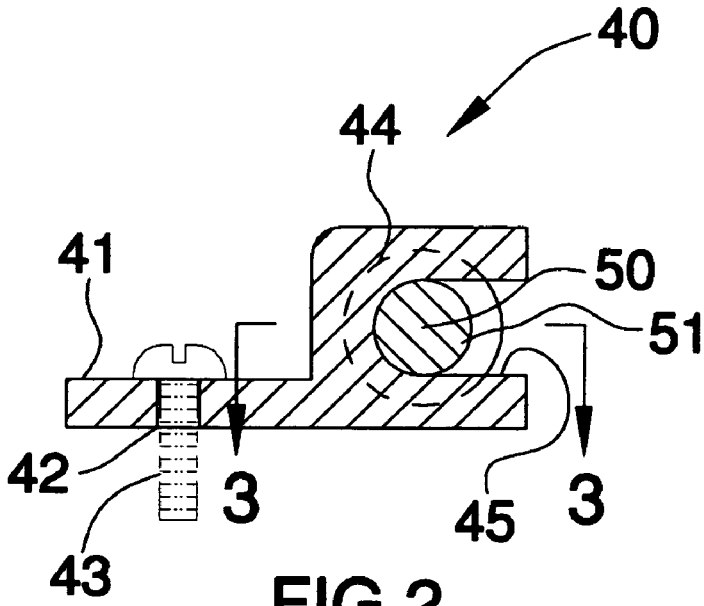
FIG. 2 is a cross-sectional view of the apparatus shown in FIG. 1, taken along line 2—2.
Figure 3:
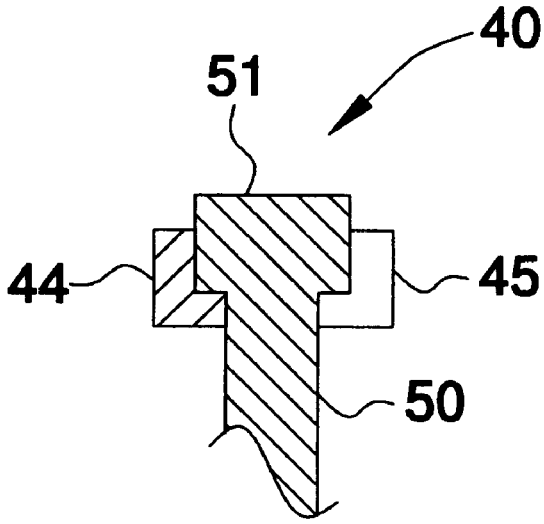
FIG. 3 is a cross-sectional view of the apparatus shown in FIG. 2, taken along line 3—3.
Figure 4:
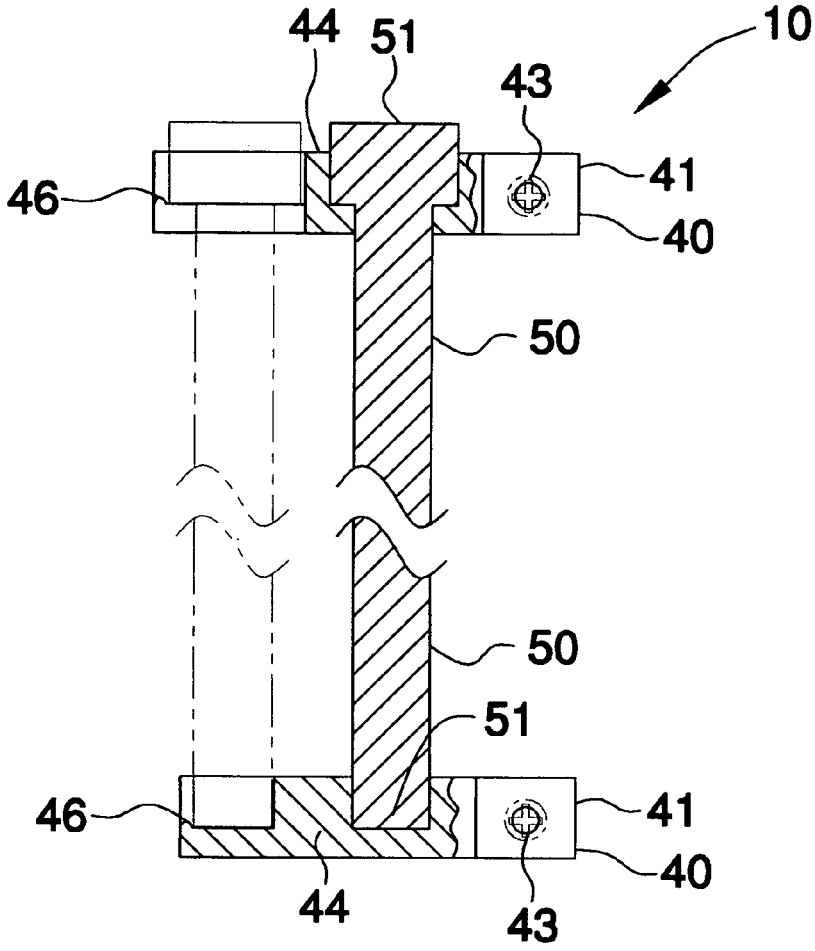
FIG. 4 is a cross-sectional view showing a bracket having a plurality of notches formed therein.
Figure 5:
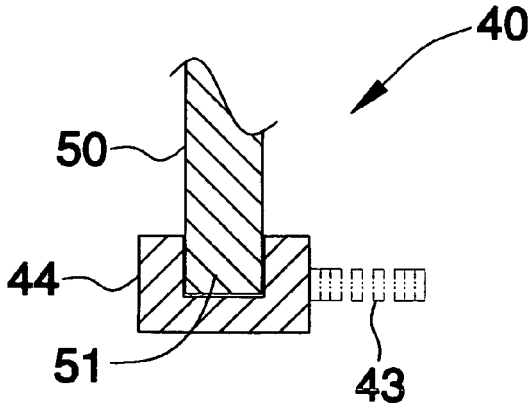
FIG. 5 is a cross-sectional view of the apparatus shown in FIG. 1, taken along line 5—5.
Figure 6:
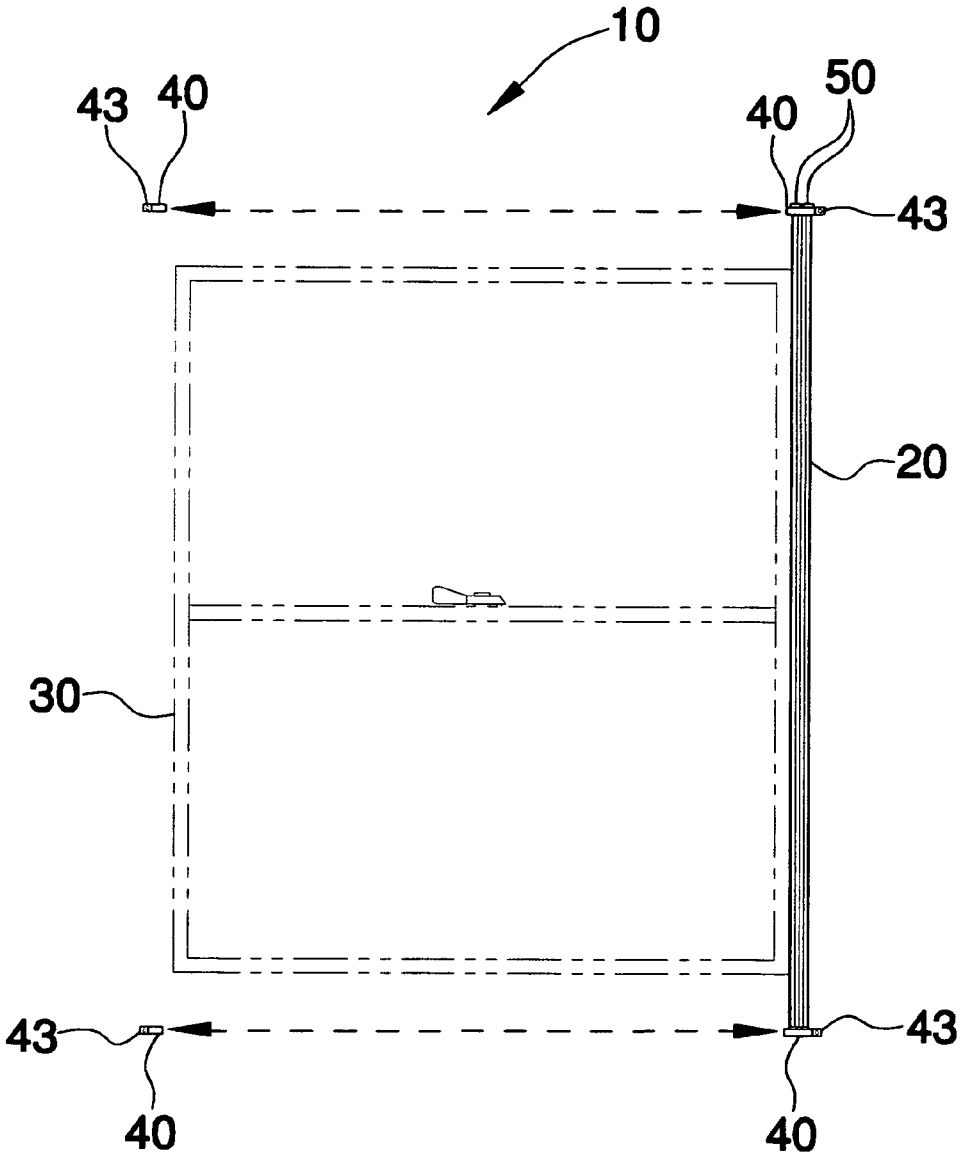
FIG. 6 is a front elevational view of FIG. 1, showing the present invention at a retracted position.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–6 by the reference numeral 10 and is intended to provide a one-way viewing window covering. It should be understood that the apparatus 10 may be employed in various environments and should not be limited to only residences.

Referring initially to FIG. 1, the apparatus 10 includes a body 20 that has a centrally disposed longitudinal axis and oppositely spaced side portions 21 equally spaced therefrom. The side portion 21 extends substantially parallel to the axis along a length of the body 20. The body 20 is formed from one-way viewing material 22 for advantageously providing a line of sight extending outwardly through a window 30 but not extending inwardly therethrough. Of course, many conventional one-way viewing materials may be employed by the present invention such as one-way viewing plastics, for example, as well known to a person of ordinary skill in the art. The body 20 is wound about one of the plurality of rods 50.

The apparatus 10 further includes a plurality of brackets 40 secured to a stationary surface (not shown) adjacent a window 30 and are disposed at opposed corners 31 thereof. Attaching the brackets at the corners 31 of the window 30, ensures that he apparatus 20 will provide complete cover for the window 30, unlike some conventional blind systems where outsider can see inside the residence around the edge of the window 30. The plurality of brackets 40 include a flange portion 41 that has an aperture 42 for receiving a fastening member 43 therethrough respectively, and an arcuate portion 44 integral with the flange portion 41 for defining a slot 45 through which the plurality of rods 50 can be positioned respectively. Select ones of the plurality of brackets 40 have a plurality of notches 46 formed therein for simultaneously supporting a plurality of rods 50 during non-use conditions, described hereinbelow. The notches 46 prevent the body 20 from hanging loosely about the rods 50 and sustaining damage, but also make it easy to extend the body 20 without having to deal with unlocking latches, for example.

Such a plurality of elongated rods 50 are vertically oriented and attached to opposed side portions 21 of the body 20. The plurality of rods 50 are formed to have substantially similar lengths and diameters respectively. The plurality of rods 50 have opposed end portions 51 engageable with the plurality of brackets 40 respectively. One of the plurality of rods 52 is conveniently movable in a direction substantially transverse to the axis. In particular, such a rod 52 is transferable between expanded and retracted positions for advantageously moving the body 20 between stretched and non-stretched positions respectively.

The appealing features of the apparatus 10 are its convenience, novelty, effectiveness, and ease of use and installation. The plastic composition of the body 20 ensures durability, which extends the life and safety providing features of the apparatus 10. This apparatus will be particularly beneficial to individuals residing in heavy foot and automobile traffic areas. The user could comfortably sit in a chair, on the bed, or get dressed knowing that they are being completely concealed from individuals on the outside. As well as in the home, this window treatment can be used in commercial establishments, such as businesses, hotels and restaurants. As mentioned in the prior art of record, law enforcement agencies will also find the apparatus 10 helpful in certain "stakeout" situations, to conceal their officers.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus positionable across a window and for concealing an interior space from being viewed from an exterior thereof, said apparatus comprising:

a body having a centrally disposed longitudinal axis and oppositely spaced side portions equally spaced therefrom, said side portions extending substantially parallel to the axis along a length of said body, said body being formed from one-way viewing material for providing a line of sight extending outwardly through the window but not extending inwardly therethrough;

a plurality of brackets secured to a stationary surface adjacent the window and being disposed at opposed corners thereof; and a plurality of elongated rods having substantially the same lengths and diameters and being vertically oriented and attached to said opposed side portions of said body, said plurality of rods having opposed end portions engageable with said plurality of brackets respectively, one said plurality of rods being movable substantially transversely to the axis between expanded and retracted positions for moving said body between stretched and non-stretched positions respectively;

one said plurality of brackets having a flange portion having an aperture for receiving a fastener member therethrough, respectively, and arcuate portions integral with said flange portion which define a plurality of respective notches formed therein for simultaneously supporting said plurality of rods during non-use conditions;

another one of said plurality of rods being statically conjoined to said one of said plurality of brackets in such a manner that said another rod remains stationary;

wherein another one of said plurality of brackets comprise a flange portion having an aperture for receiving a fastening member therethrough respectively, and an arcuate portion integral with said flange portion and defining a notch in which said one of said plurality of rods can be positioned respectively when in said extended position;

wherein said body is wound about said one rod when in said retracted position;

said one rod being juxtaposed adjacent to said another rod at one side of the window after said one rod is traversed to said another rod and supported in one of said notches of said plurality of notches;

wherein each bottom end of said plurality of rods are countersunk into selected ones of said plurality of notches while each top end of said plurality of rods are exposed above associated ones of said plurality of notches.

2. The apparatus of claim 1, wherein said body is formed from plastic.

* * * * *